United States Patent [19]

Achter et al.

[11] 3,993,925

[45] Nov. 23, 1976

[54] ELECTRON BEAM COLLECTOR FOR TRANSIT TIME TUBES

[75] Inventors: Eugen Achter, Munich; Wilhelm Bibracher, Otterloh Gem Brunntal; Wolf Wiehler, Neubiberg, all of Germany

[73] Assignee: Siemens Aktiengesellschaft, Berlin & Munich, Germany

[22] Filed: Oct. 6, 1975

[21] Appl. No.: 619,933

[30] Foreign Application Priority Data

Oct. 21, 1974 Germany ..... 2449890

[52] U.S. Cl. ..... 315/5.38; 313/30; 315/3.5

[51] Int. Cl.[2] ..... H01J 23/02

[58] Field of Search ..... 315/3.5, 5.35, 5.38; 313/30

[56] References Cited

UNITED STATES PATENTS

| | | | |
|---|---|---|---|
| 2,955,225 | 10/1960 | Sterzer | 315/5.38 X |
| 2,958,804 | 11/1960 | Badger et al. | 315/5.38 X |
| 3,368,104 | 2/1968 | Mc Cullough | 315/5.38 |
| 3,471,739 | 10/1969 | Espinosa | 315/3.5 |
| 3,626,230 | 12/1971 | Stewart | 315/5.38 |
| 3,823,772 | 7/1974 | Laverino et al. | 315/5.38 X |
| 3,824,425 | 7/1974 | Rawls, Jr. | 315/5.38 |

*Primary Examiner*—Saxfield Chatmon, Jr.
*Attorney, Agent, or Firm*—Hill, Gross, Simpson, Van Santen, Steadman, Chiara & Simpson

[57] ABSTRACT

An electron beam collector for transit time tubes, in particular traveling wave tubes, includes a plurality of metallic electrodes which surround the electron beam and which are spaced from one another by insulating bodies. The spacing components are firmly and preferably directly connected to the electrodes which they serve to space. The electrodes are, in each case, embraced by a sleeve which has a thermal coefficient expansion that is small in comparison to the electrodes and matched to that of the spacing components.

12 Claims, 1 Drawing Figure

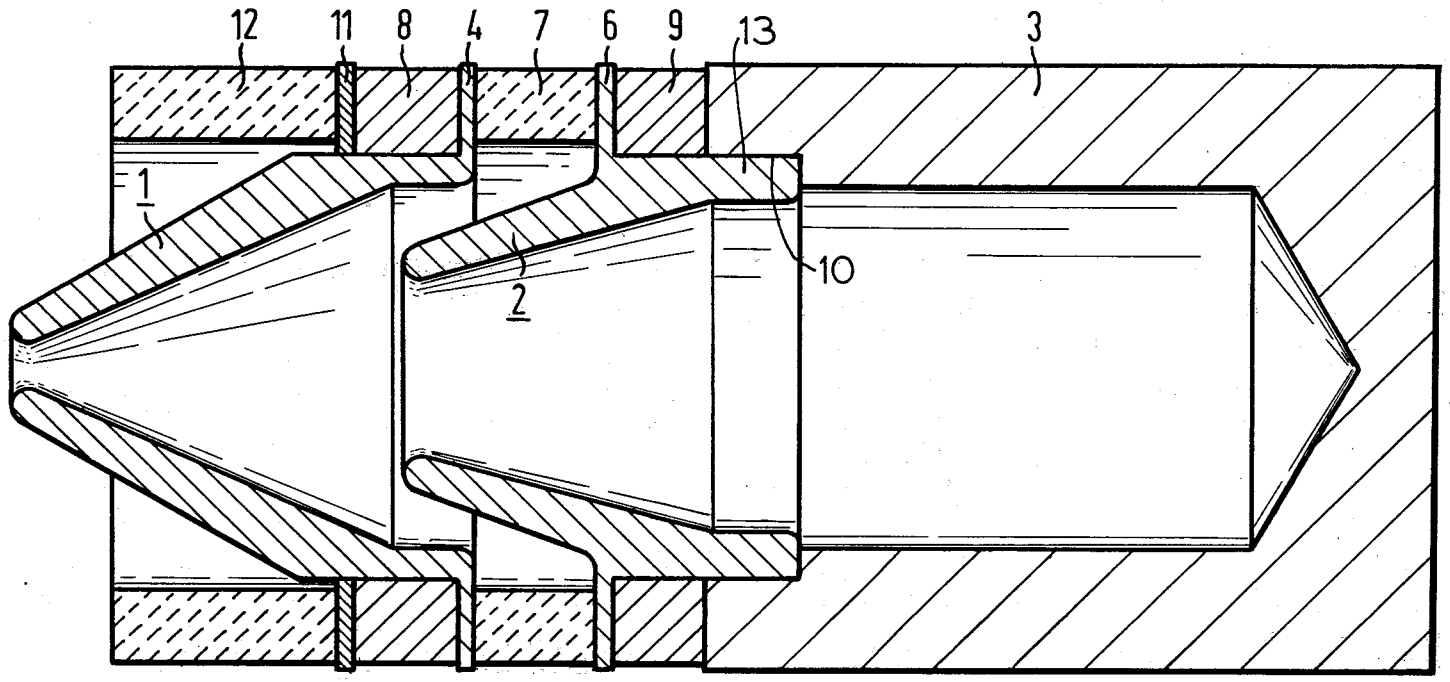
3
13
9
6
7
4
8
11
12
10
2
1

ELECTRON BEAM COLLECTOR FOR TRANSIT TIME TUBES

BACKGROUND OF THE INVENTION

1. Field of the Invention

This invention relates to an electron beam collector for transit time tubes, in particular traveling wave tubes, having a plurality of metallic electrodes which surround the electron beam and which are spaced from one another by insulating bodies.

2. Description of the Prior Art

In collector which are subjected to a high thermal load and which are electrically insulated from their environment, it is of particular importance to discharge the heat loss developed during the operation of the tube to a sufficient extent in order to avoid breaks in power or even complete breakdowns. If the collectors are of multi-stage design, the heat discharge becomes particularly difficult since the electrodes are additionally also separated from one another by insulating bodies which, naturally, are poor heat conductors and promote a non-uniform heat distribution along the surface of the collector.

In fact, in a multi-stage collector it would be particularly desirable to achieve a good transition of heat between the individual electrodes as the quantity of heat converted in the individual collector stages is also very sensitive to the modulation of the tube and, therefore, the electrodes are exposed to fluctuating thermal loads which change in shock-like fashion and which rapidly lead to impermissably high local temperature gradients.

A multi-stage collector of typical construction is disclosed in U.S. Pat. No. 3,368,104. In this design, the individual electrodes are separated by a stack of insulating rings, stack upon one another with interlying flexible metal layers. The metal layers are extended out of the stack and are connected either directly to the electrodes or, via another, likewise flexible flange. The insulating rings themselves are not secured to the electrodes because of the differing heat expansion. It is readily apparent that in collectors of this type of construction, the heat transport capacity between the individual electrode stages, and also the heat emission to the outer surface of the collector is not favorable. To this may also be added the fact that the construction is extremely fragile, since the electrodes are held in position only by the flexible metal layers. The electrodes cannot be allowed to be exposed to mechanical load, and in particular not to vibrations. Finally, the aforementioned metal layers generally consist of magnetic materials, for example "Kovar", which is also a poor heat conductor and which has a heat expansion behavior that corresponds approximately to that of aluminum oxide or beryllium oxide. Magnetic disturbances of the electron beam should be avoided, however, without fail in the region of the collector.

In order to increase mechanical stability and the heat discharging capacity other structures have been devised. If one refers to U.S. Pat. No. 3,662,212, in particular to FIG. 3, it will become apparent that it is known to totally surround the individual collector stages with an inherently stable pile of ceramic rings stacked one upon another with interposed copper ribs, where the ribs lead alternately to the electrodes and to the casing. However, even in this somewhat expensive arrangement, the heat exchange between the individual electrodes, which fundamentally takes place only along the ribs, is still not satisfactory.

Also, as will be discussed below, it is known in the art to utilize non-deformable clamping rings in collector structures, such as disclosed in U.S. Pat. No. 3,586,100.

SUMMARY OF THE INVENTION

The object of the invention is to provide a multi-stage collector which withstands high thermal loads and fluctuating thermal loads, which is particularly mechanically sturdy, which does not contain any magnetic materials, and which can be produced in a comparatively simple fashion.

For the realization of the above object, in a collector of the general type described above, according to the invention it is proposed that the spacing components be firmly and preferably directly connected to the electrodes which they serve to space from one another, and that the electrodes are, in each case, spanned or embraced by a sleeve which possesses a small heat expansion in comparison to the electrodes, in such a manner that the radial heat expansion of the electrodes is matched to the heat expansion of the spacing components which are connected to the electrodes.

Advantageously, the electrodes will include at least one outwardly directed projection and a spacing ring will be disposed between and connected to such projections.

Another advantageous feature of the invention resides in the provision of annular ring-shaped sleeves which also bear against the electrode projections and which are secured, preferably by soldering, on the hole of the contact surface to the electrodes.

The invention begins with the consideration that the metallic electrodes should not, as in prior constructions, be connected by way of flexible bridges to the requisite insulators, but that their heat expansion behavior should be matched to that of the insulating spacing components in accordance with suitably designed clamping elements. This provides the possibility of a direct, large-area contact with excellent heat communication. The sleeve itself conducts heat equally well when, for example, it consists of the non-magnetic material molybdenum, so that the heat loss can also be emitted over a wide front to the outer surface. The compact joint between inherently solid components which are secured to one another over a large area imparts an extremely high mechanical stability to a collector constructed in accordance with the invention.

As mentioned above in respect of U.S. Pat. No. 3,586,100, the use of relatively non-deformable clamping rings in collectors is not new per se. In the arrangement disclosed in the last-mentioned patent, a cooling body collar exhibiting low heat expansion serves to maintain a constantly good contact between the actual collector and a cooling body which surrounds the collector. However, this is not a multi-stage collector, but a collector of environmental potential and all of the problems raised by electrode insulation, on which the present invention is based, do not occur.

BRIEF DESCRIPTION OF THE DRAWING

Other objects, features and advantages of the invention, its organization, construction and operation will be best understood from the following detailed description, taken in conjunction with the accompanying drawing, on which there is illustrated a multi-stage collector, shown in an enlarged longitudinal sectional view.

On the drawing those components of a collector which are not necessary for the understanding of the invention, for example the electrical supply lines, have been omitted.

DESCRIPTION OF THE PREFERRED EMBODIMENTS

The drawing illustrates an elevational sectional view of a two-stage collector intended for use in a traveling wave tube. This collector is cylindrically symmetrical and contains a first electrode 1, a second electrode 2 and a cup-shaped collector base 3.

The two electrodes 1 and 2 are both funnel shaped and are arranged in series in the electron beam direction, and in particular are partially fitted into one another. Each of the electrodes 1 and 2 is also provided with an outwardly directed projection 4 and 6, respectively, the projections being spaced from one another by an insulating spacing ring 7.

Annular sleeves 8 and 9, consisting of molybdenum, span or brace the electrodes 1 and 2, respectively, and bear against the relevant electrode projections 4 and 6.

The first electrode 1 is additionally embraced by a flange 11, which is of similar shape to the projection 4 and which bears against the annular sleeve 8.

Another insulating ring 12 (the first insulating ring in the beam direction) which has the same diameter as the insulating ring 7 is disposed opposite the flange 11 and connected thereto.

The cup-shaped collector base 3 bears against the annular sleeve 9. The cup-shaped collector base 3 includes a recess or counterbore 10 which receives and encloses a rear portion 13 of the electrode 2.

All of the components are brazed to one another at their contact surfaces. The insulating ring 12 can be connected to other flanges which allow the entire two-stage collector to be secured in the remainder of the tube.

The described collector design possesses an extremely high resistive capacity in respect of mechanical influences, all of the cylindrical-symmetrical individual components can be produced comparatively simply and can be assembled and brazed easily. All of the components are connected to one another via large heat-conducting cross sections employing good heat-conducting metals. As the molybdenum rings are also continuously brazed to the copper components on their inner diameters, the entire surface of the molybdenum ring can contribute to the heat transport.

The weakest element in the heat conduction chain of this arrangement is constituted by the insulating rings, which are generally manufactured from $Al_2O_3$ ceramic. As this material is a poor heat conductor, under extreme load it is advisable to employ BeO ceramic which exhibits considerably better heat conduction.

The mechanical stability, temperature resistance and heat shock stability of the described arrangement is even further promoted in that the ceramic rings are, in each case, connected to copper rings (projection and flange) which, on the one hand, because of their ductility, serve as buffers, and, on the other hand, are obstructed from expanding by the annular sleeves and therefore can only form very small shear forces at the joints. The ceramic-metal joints also remain vacuum tight over a long term.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. An electron beam collector for transit time tubes, in particular traveling wave tubes, comprising:

a plurality of hollow metal electrodes for receiving an electron beam;

a plurality of hollow insulating spacers, at least one of said insulating spacers located between and firmly and directly connecting adjacent metal electrodes; and a plurality of sleeves, each of said sleeves having a thermal coefficient of expansion which is small compared to that of said electrodes and matched to that of said spacers, and each of said sleeves circumscribing and embracing a respective electrode.

2. The electron beam collector of claim 1, wherein each of said electrodes and spacers are annular and arranged in series in the beam direction, each of said electrodes comprises at least one radially directed projection, and an annular spacer is between and connected to said projections of adjacent electrodes.

3. The electron beam collector of claim 2, wherein said sleeves are annular sleeves, each of said sleeves bearing against a radially directed projection of an electrode and secured to that electrode over the entire contact surface thereof.

4. The electron beam collector of claim 1, comprising an annular flange embracing and directly connected to one of said electrodes, said flange contacting and disposed between a spacer and a sleeve.

5. A two-stage electron beam collector according to claim 4, comprising a cup-shaped collector base, and wherein, as viewed in the beam direction, a first hollow insulating spacer and said flange and a first sleeve and a radial projection of a first electrode and a second hollow insulating spacer and a radial projection of a second electrode and a second sleeve and said collector base are all connected in a series relation, said collector base embracing and firmly connected to a portion of said second electrode.

6. A two-stage electron beam collector for transit time tubes, in particular traveling wave tubes, comprising:

first and second hollow annular electrodes, each of said electrodes including an outwardly directed projection, an annular outer surface adjacent said projection and a conically-shaped beam entrance portion, said electrodes axially aligned in the beam direction with said conically-shaped beam entrance portion of said second electrode extending into the hollow interior or said first electrode;

a cup-shaped collector base including a counterbore portion embracing and connected to a first portion of said annular surface of said second electrode;

an annular first sleeve including an inner surface which embraces a second portion of said annular surface of said second electrode, said first sleeve disposed between and connected to said projection of said second electrode and said cup-shaped collector base;

an annular insulating first spacing ring connected between and to said radial projections of said first and second electrodes;

an annular second sleeve including an inner surface which embraces a first portion of said annular surface of said first electrode, said second sleeve connected to said radial projection of said first electrode;

an annular ring-type flange having an inner surface embracing a second portion of said annular surface of said first electrode, said flange connected to said second sleeve; and an annular insulating second spacing ring surrounding said first electrode and connected to said flange, each of said sleeves having a thermal coefficient of expansion that is small compared to that of said electrodes and matched to that of said spacing rings.

7. The electron beam collector of claim 6, wherein each of said sleeves comprises molybdenum.

8. The electron beam collector of claim 6, wherein each of said spacing rings comprises ceramic material.

9. The electron beam collector of claim 8, wherein the ceramic comprises $Al_2O_3$.

10. The electron beam collector of claim 8, wherein the ceramic comprises BeO.

11. The electron beam collector of claim 6, wherein said projections comprise copper.

12. The electron beam collector of claim 6, wherein said flange comprises copper.

* * * * *